US008757429B2

(12) United States Patent
Stevens

(10) Patent No.: US 8,757,429 B2
(45) Date of Patent: Jun. 24, 2014

(54) HINGED OVERCAP FOR A CONTAINER

(75) Inventor: James P. Stevens, Florence, SC (US)

(73) Assignee: Sonoco Development, Inc., Hartsville, SC (US)

( * ) Notice: Subject to any disclaimer, the term of this patent is extended or adjusted under 35 U.S.C. 154(b) by 745 days.

(21) Appl. No.: 12/528,251

(22) PCT Filed: Feb. 19, 2008

(86) PCT No.: PCT/US2008/002166

§ 371 (c)(1),
(2), (4) Date: Aug. 21, 2009

(87) PCT Pub. No.: WO2008/103343

PCT Pub. Date: Aug. 28, 2008

(65) Prior Publication Data

US 2010/0059537 A1 Mar. 11, 2010

Related U.S. Application Data

(60) Provisional application No. 60/903,211, filed on Feb. 23, 2007.

(51) Int. Cl.

| | |
|---|---|
| ***B65D 43/14*** | (2006.01) |
| ***B65D 43/02*** | (2006.01) |
| ***B65D 45/02*** | (2006.01) |

(52) U.S. Cl.

CPC ..... *B65D 43/02* (2013.01); *B65D 45/02* (2013.01)

USPC ..... 220/826; 220/780; 220/796; 220/810; 215/235

(58) Field of Classification Search

CPC .... B65D 5/6623; B65D 5/549; B65D 5/6682; B65D 5/6694; B65D 5/544; B65D 5/547; B65D 45/02; B65D 43/02

USPC ..... 220/810, 834, 836, 837, 845, 847, 780, 220/796, 244, 258.1; 215/235, 236, 317

See application file for complete search history.

(56) References Cited

U.S. PATENT DOCUMENTS

| | | | |
|---|---|---|---|
| 2,031,312 | A | 2/1936 | Horlick, Jr. |
| 2,069,213 | A | 2/1937 | Carew |
| 2,984,381 | A | 5/1961 | Bennett |
| 3,412,890 | A | 11/1968 | Rich |

(Continued)

FOREIGN PATENT DOCUMENTS

| | | |
|---|---|---|
| AU | 519377 | 3/1981 |
| CH | 468 286 | 2/1969 |

(Continued)

*Primary Examiner* — Robert J Hicks
*Assistant Examiner* — Kareen Rush
(74) *Attorney, Agent, or Firm* — Flaster/Greenberg, P.C.

(57) ABSTRACT

An overcap (14) is provided for a container (10) having a hinge (26) supporting a moveable flap (28) to provide access to the container reservoir. First and second skirts (34, 44) are provided for engaging an upper rim on the container body, with one skirt permitting the mounting of the overcap in two alternate positions. In the first position, only the first skirt (34) engages the upper rim, which allows a removable membrane to be positioned on the upper rim of the container. In the second position, the membrane is removed and both the first and second skirts engage the inner and outer edges of the rim of the container.

15 Claims, 7 Drawing Sheets

(56) References Cited

U.S. PATENT DOCUMENTS

| | | | | | |
|---|---|---|---|---|---|
| 3,417,897 | A | | 12/1968 | Johnson | |
| 3,421,654 | A | | 1/1969 | Hexel | |
| 3,516,572 | A | | 6/1970 | Davis | |
| 3,572,413 | A | | 3/1971 | Livingstone | |
| 3,606,074 | A | | 9/1971 | Hayes | |
| 3,624,789 | A | | 11/1971 | Peyser et al. | |
| 3,773,232 | A | | 11/1973 | Hidding | |
| 3,880,973 | A | | 4/1975 | Yoshikawa et al. | |
| 3,942,677 | A | * | 3/1976 | Hagen et al. | 220/304 |
| 4,037,746 | A | | 7/1977 | Ver Hage | |
| 4,042,143 | A | | 8/1977 | Biggins | |
| 4,091,953 | A | | 5/1978 | Daenen | |
| 4,561,562 | A | | 12/1985 | Trombly | |
| 4,718,567 | A | | 1/1988 | la Vange | |
| 4,754,889 | A | | 7/1988 | Debetencourt | |
| 4,759,455 | A | | 7/1988 | Wilson | |
| 4,881,668 | A | * | 11/1989 | Kitterman et al. | 222/482 |
| 5,147,059 | A | | 9/1992 | Olsen | |
| 5,253,996 | A | | 10/1993 | Moore | |
| 5,339,993 | A | | 8/1994 | Groya | |
| 5,409,126 | A | | 4/1995 | DeMars | |
| 5,622,273 | A | | 4/1997 | Kelly | |
| 5,678,720 | A | | 10/1997 | Van Melle | |
| 5,806,710 | A | | 9/1998 | Shiffer | |
| 5,855,288 | A | | 1/1999 | Dallas, Jr. | |
| 5,931,828 | A | | 8/1999 | Durkee | |
| 6,015,061 | A | | 1/2000 | Lowry | |
| 6,119,890 | A | | 9/2000 | Kawamata | |
| 6,220,471 | B1 | | 4/2001 | Lowry | |
| 6,234,386 | B1 | | 5/2001 | Drummond | |
| 6,237,791 | B1 | | 5/2001 | Beck et al. | |
| 6,419,101 | B1 | | 7/2002 | Hessel | |
| 6,450,355 | B1 | | 9/2002 | Lowry | |
| 6,460,759 | B1 | | 10/2002 | Lowry et al. | |
| 6,510,971 | B1 | | 1/2003 | Martin | |
| 6,523,713 | B1 | * | 2/2003 | Helms | 220/831 |
| 6,688,486 | B2 | | 2/2004 | Diamond | |
| 6,877,630 | B2 | | 4/2005 | von Spreckelsen et al. | |
| 6,883,689 | B2 | | 4/2005 | Odet | |
| 7,134,569 | B2 | * | 11/2006 | Freek et al. | 220/711 |
| 7,337,916 | B2 | * | 3/2008 | Clougherty | 220/785 |
| 8,215,514 | B2 | * | 7/2012 | Morenstein et al. | 220/376 |
| D667,262 | S | * | 9/2012 | Morenstein et al. | D7/392.1 |
| 8,328,036 | B2 | | 12/2012 | Stevens | |
| 2002/0017501 | A1 | | 2/2002 | Clements et al. | |
| 2004/0011791 | A1 | | 1/2004 | Oh | |
| 2004/0011803 | A1 | | 1/2004 | D'Amato | |
| 2005/0045636 | A1 | | 3/2005 | Lown | |
| 2005/0072783 | A1 | | 4/2005 | Choi | |
| 2005/0109781 | A1 | * | 5/2005 | Chasteen | 220/258.1 |
| 2005/0167430 | A1 | | 8/2005 | Varadarajan | |
| 2005/0236465 | A1 | | 10/2005 | Stevens | |
| 2006/0219652 | A1 | * | 10/2006 | Grant | 215/237 |
| 2007/0017891 | A1 | * | 1/2007 | Herr | 215/228 |

FOREIGN PATENT DOCUMENTS

| | | | |
|---|---|---|---|
| CH | 468286 | | 2/1969 |
| DE | 1298926 | | 7/1969 |
| DE | 3234848 | A1 | 3/1984 |
| DE | 19851076 | A1 | 5/2000 |
| EP | 0 004 075 | A2 | 6/1979 |
| EP | 1344618 | A1 | 9/2003 |
| EP | 1544124 | A1 | 6/2005 |
| EP | 1 561 696 | A | 8/2005 |
| EP | 1561696 | A1 | 8/2005 |
| FR | 2538349 | A1 | 6/1984 |

* cited by examiner

HINGED OVERCAP FOR A CONTAINER

RELATED APPLICATIONS

The present application is the national stage filing under 35 USC 371 of international application no. PCT/US2008/002166, filed Feb. 16, 2008, which claims the benefit of provisional application Ser. No. 60/903,211, filed Mar. 23, 2007.

FIELD OF THE INVENTION

The present invention relates generally to a cap for a container.

BACKGROUND OF THE INVENTION

Often, containers that store perishable products, such as food, include a removable membrane sealed to the rim of the container. The membrane is used to help prevent the transfer of oxygen, moisture and other contaminants into the container. The membrane also provides a measure of tamper evidency. When a consumer buys the container, the membrane is removed and discarded. The container can then be used to dispense the product.

It is known to include an overcap to provide access to the product retained within a container. For example, U.S. Pat. No. 4,718,567 to LaVange shows an overcap for an open-mouthed container. The cap has two annular skirts, with one skirt including an inwardly projecting rib that engages a rim on the container to retain the cap on the container. The inner skirt is sized to fit within the open end of the container, positioning the rim between the two skirts. The cap also includes a hinged flap that selectively closes an opening in the overcap, which forms the opening for the container.

US 2005/0236465 to Stevens shows an overcap with an outer annular skirt adapted to engage the rim of a container. A hinge is provided across a top panel of the overcap to allow a portion of the top panel to be selectively rotated with respect to the remaining portions of the top panel to provide access to the product within the container. The skirt portion includes an inwardly extending rib that engages the container rim to secure the overcap to the container. The hinged portion of the overcap can be opened by moving the rib on the hinged portion over the rim of the container.

U.S. Pat. No. 3,412,890 to Rich shows an overcap for a container having a hinged portion, an inner skirt and an outer skirt. The skirts are sized to engage opposite sides of the container rim. When the hinged portion of the cap is opened, the inner and outer skirts are moved away from the rim of the container. The inner skirt includes an outwardly projecting rib that engages a matching groove on the inside surface of the rim of the container.

US 2005/0167430 to Varadarajan shows an overcap for a container having an annular skirt with a pair of inwardly projecting ribs that form upper and lower grooves for receipt of the container rim therein. The overcap can be positioned in a first position, with the rim of the container engaged within the relatively lower groove, to retain a sealing membrane on the rim of the container and with the membrane being spaced from the inside surface of the overcap. In a second position, the container rim is engaged within the relatively upper groove on the overcap and the container is sealed by the engagement of the container rim with the skirt and the inside surface of the top panel of the overcap.

SUMMARY OF THE INVENTION

An overcap for a container is provided that engages the container in two alternate positions and provides access to the inside of the container using a movable flap portion. The overcap includes a hinge that divides the cap into first and second flap portions. At least one of the flap portions is moveable away from the container rim to provide access to the interior of the container. The flap portions each include a first skirt extending downward from the outer edge of the flap. The first skirt has an inwardly projecting lower rib and an inwardly projecting upper rib formed on the inside surface of the skirt. The ribs create a relatively lower groove between the two ribs and an upper groove between the upper rib and the bottom of the flap portions. The grooves are sized to engage an upper rim or similar feature on the container.

The flap portions also include a second skirt extending downward from the bottom of the flap. The second skirt is positioned radially inward of the first skirt and is relatively shorter than the first skirt. The lower edge of the inner skirt is positioned relatively above the container rim when the overcap is retained in the lower groove or first position. In a second position, with the overcap in the second position, the container rim is sandwiched between the first and second skirts, providing retention of the overcap on the rim.

BRIEF DESCRIPTION OF THE DRAWINGS

There is shown in the drawings a number of embodiments that are presently contemplated. Reference should be made to the description of these embodiments as well as the claims that follow for defining the scope of the invention.

DETAILED DESCRIPTION OF THE DRAWINGS

Figure 1:
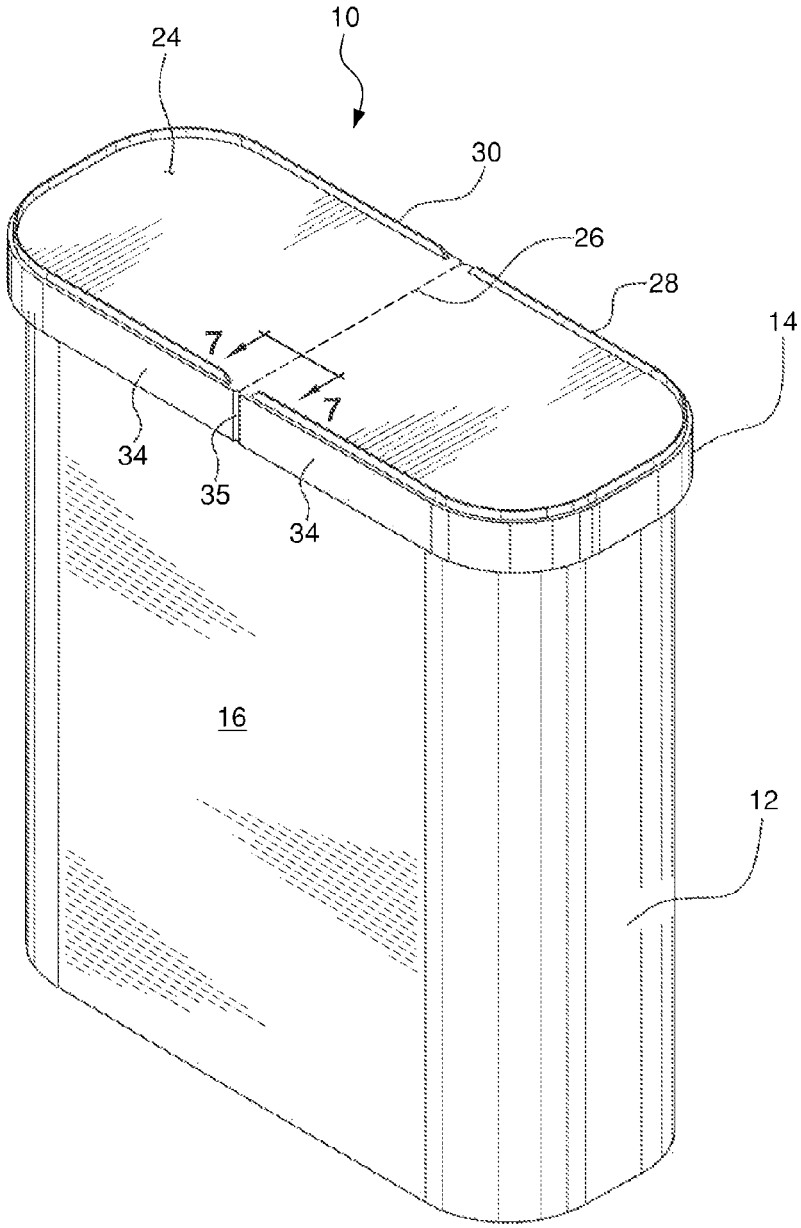
FIG. 1 shows an isometric view of a container and overcap combination, with the cap in a first position, closing the open mouth of the container.

In the drawings, where like numerals identify like elements, there is shown a container and overcap combination, which is generally referred to by the numeral 10. In FIG. 1, the container 10 includes a container body 12 with the overcap 14 positioned thereon. The container body 12 comprises a hollow reservoir defined by a bottom wall (not shown), an annular upstanding side wall 16 and an open-mouth 18 (see FIG. 4). An annular, upper rim 20 is defined at the upper end of the side wall 16. A removable membrane 22 is attached to the rim 20 (see FIG. 2) to seal the reservoir and contents of the container body 12. As illustrated in FIG. 3, the upper rim 20 of the container 12 is formed by a rolled portion of the sidewall 16 of the container body 12. However the rim may have a different form or may be made by a separately attached element, such as a crimped bead (not shown).

Figure 2:
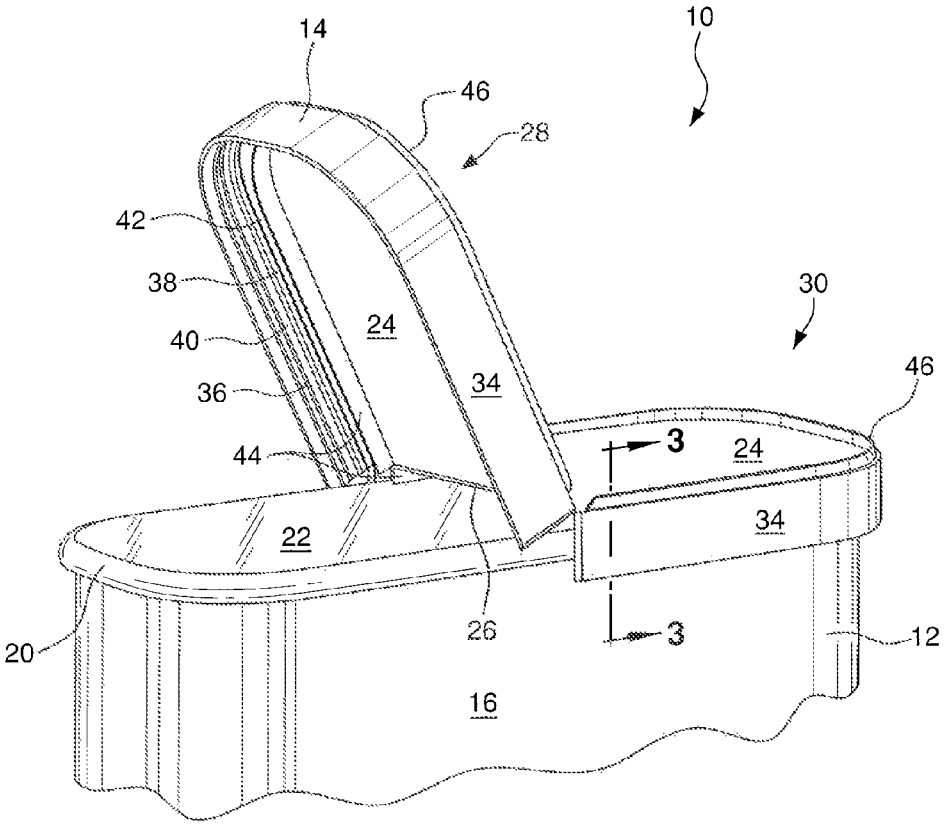
FIG. 2 shows a partial isometric view of the container and overcap combination, with the cap in the first position and a flap portion opened, exposing a sealed membrane positioned across the mouth of the container.
Figure 3:
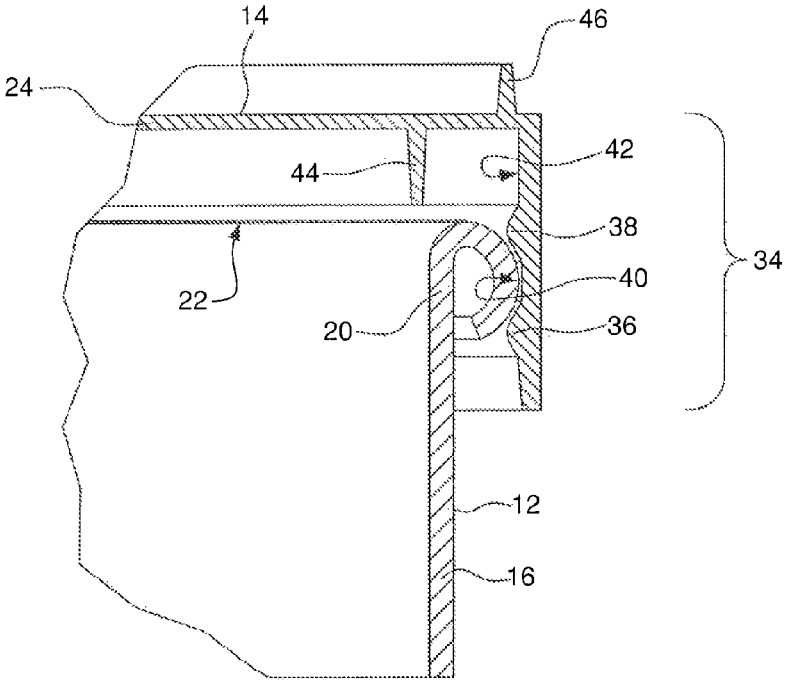
FIG. 3 shows a partial cross-section of the container and overcap as taken along line 3-3 in FIG. 2.

Referring to FIG. 2, the overcap 14 as illustrated includes a top panel 24 divided into two portions by a hinge 26. The hinge 26 bisects the panel 24 into a first flap portion 28 and a second flap portion 30, with one or both of the flaps being movable about the hinge 26. The overcap 14 is preferably integrally molded with the hinge 26 formed as a living hinge. In FIG. 2, the first flap portion 28 is shown in the open position, exposing the top of the container body 12. As illustrated, the sealing membrane 22 is affixed to the container rim 20 and covers the mouth 18 of the container 12.

The two flap portions 28, 30 each include a first skirt 34 extending downward from the outer edge of the panel 24. A break 35 (see FIG. 1) is formed in the first skirt 34 along the line of the hinge 26 so that the relevant portions of the skirt 34 associated with each flap 28, 30 can be separated, when one flap is pivoted about the hinge 26. A frangible bridge or an overlap of the edges may be provided along the break 35 to create a 360° degree surface surrounding the rim 20 of the container 12. As best seen in the cross section of FIG. 3, the first skirt 34 includes an inwardly projecting first or lower rib 36 and a second or relatively upper rib 38, formed on the inside surface of the wall of the skirt 34. The ribs 36, 38 define a relatively lower groove 40 between the two ribs and an upper groove 42 between the upper rib 38 and the bottom surface of the top panel 24.

The lower groove 40 and upper groove 42 are sized to engage the upper rim 20 of the container body 12. The lower groove 40 and upper groove 42 are not required to have identical length or depth. For example, it may be appropriate for the membrane 22 to drape over the upper rim 20, thereby increasing the overall width of the upper rim 20. As such, the lower groove 40 and the upper groove 42 are likely dimensioned differently to provide an optimum fit for the membrane 22, when present. The upper groove 42 is preferably dimensioned slightly smaller than the lower groove to optimize the fit and to ensure freshness of the product within the container body 12, when the overcap 14 is in the second position.

A second skirt 44 is formed on the bottom surface of the top panel 24, radially inward from the first skirt 34. The second skirt 44 extends downwardly from the top panel 24 to a position substantially equal to the bottom of the upper groove 42. The second skirt may contact the membrane 22 when the rim is in the first position to help stabilize the overcap 14. However, in some instances, during shipment of the container with a sealed membrane, the membrane will tend to rise or form a dome, due to the difference in ambient pressure and the internal pressure within the container. Thus, the relative position of the first groove and the lower edge of the inner skirt may be adjusted such that the doming of the membrane does not move the overcap or in extreme situations force the overcap off the container rim.

Figure 5:
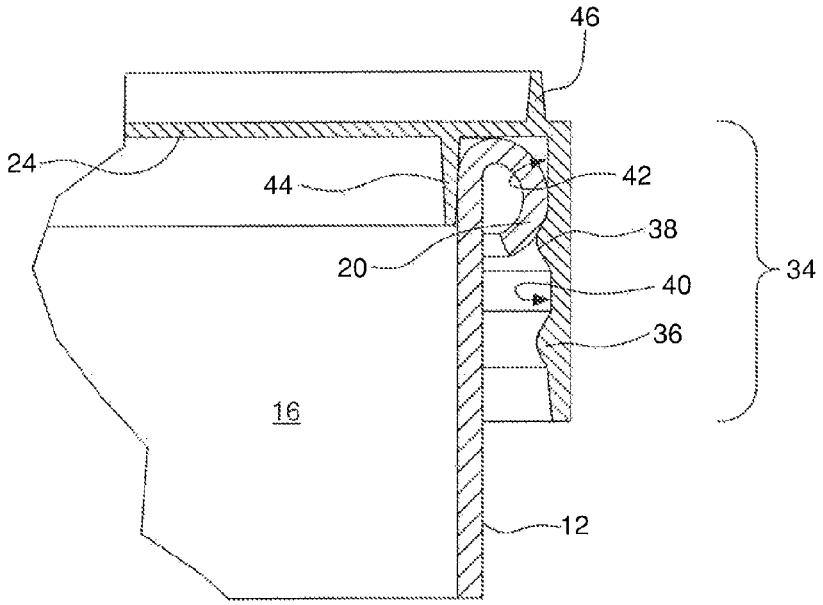
FIG. 5 shows a partial cross-section of the container and overcap as taken along line 5-5 in FIG. 4.

The second skirt 44 is inwardly spaced from the first skirt 34 such that the upper rim 20 of the container body 12 is preferably engaged between the two skirts 34, 44 when the rim 20 is positioned in the upper groove 42 (see FIG. 5). A gap may be provided in the second skirt 44, adjacent the hinge 26, so that the two sections of the second skirt 44*a*, 44*b* may also pivot about the hinge 26 when one flap portion is opened. Alternatively, as particularly shown in FIG. 7, the seam 45 between the two sides 44*a*, 44*b* of the inner skirt 44 may include an abutting surface or an overlapping edge, similar to break 35 in the outer skirt 34.

As illustrated, an upper rib 46 is formed on the outside surface of the top panel 24. The upper rib 46 facilitates stackability of the overcaps 14 prior to assembly with the container body 12. The upper rib 46 may also serve to stabilize the stacking of overcap and container combinations 10, with the bottom wall (not shown) of the container body 12 forming a rim that fits either inwardly or outwardly of the upper rib 46 when two containers are stacked on top of one another. The upper rib 46 may also stiffen the flap portions 28, 30 and assist in the handling of the overcap 14 during opening and closing. Other structures may be added to the surface of the top panel 24 to stiffen the panel or for other purposes.

Referring again to FIGS. 2 and 3, the overcap 14 is shown in the first position, where the upper rim 20 engages the lower groove 40 on the inside surface of the first skirt 34. In this first position, the overcap 14 is affixed to the container 12. As illustrated, the second or inner skirt 44 is spaced from the removable membrane 22. However, the skirt 44 may contact the membrane, although preferably does not pierce the surface of the membrane. Thus, in the first position, the container body 12 is in a sealed condition and the overcap 14 is retained on the rim of the container body 12, within the first or lower groove 40. Once the container 10 is ready for use, the overcap 14 can be separated from the container body 12 and the membrane 22 removed from the rim 20—exposing the mouth 18 and contents in the reservoir formed by the container body 12. The overcap 14 is then placed back onto the rim 20 of the container body 12 and engaged within the second groove 42 on the inside surface of the first skirt 34.

Figure 4:
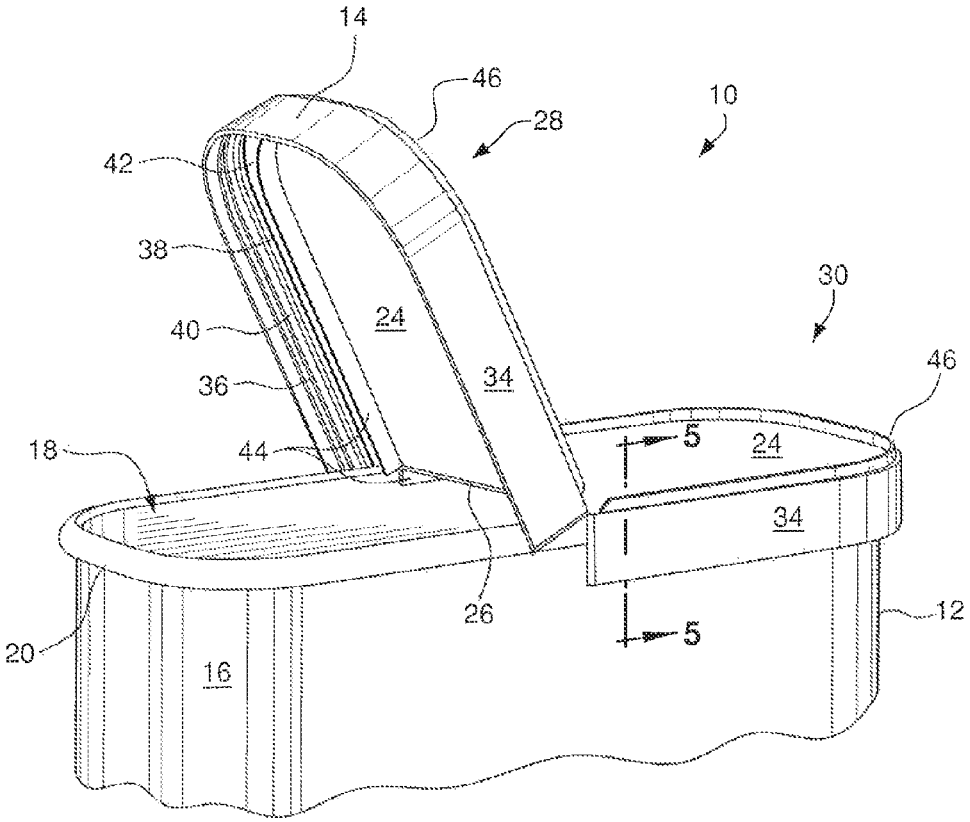
FIG. 4 shows a partial isometric view of the container and overcap combination, with the cap in a second position and the flap portion opened, exposing the open mouth of the container.

Referring now to FIGS. 4 and 5, the overcap 14 is shown in the second position with the upper rim 20 engaged within the second or upper groove 42 and the second skirt 44 positioned inside of the rim 20 and engaging the inside surface of the sidewall 16. When the rim 20 in positioned in the second groove 42, additional retention force is created by the outside or first skirt 34 and the inside or second skirt 44, thus stabilizing the overcap 14 on the rim 20. Also, while in the second position, the first flap portion 28 and its associated skirts 34, 44 can be rotated about the hinge 26 to open the container, while the second flap portion 30 is maintained affixed to the container rim 20. Preferably, both flap portions 28, 30 are designed to open. Thus, the second flap portion 30 can be opened about the hinge 26, while the first flap portion 28 maintains the overcap 14 affixed to the container rim 20.

Figure 6:
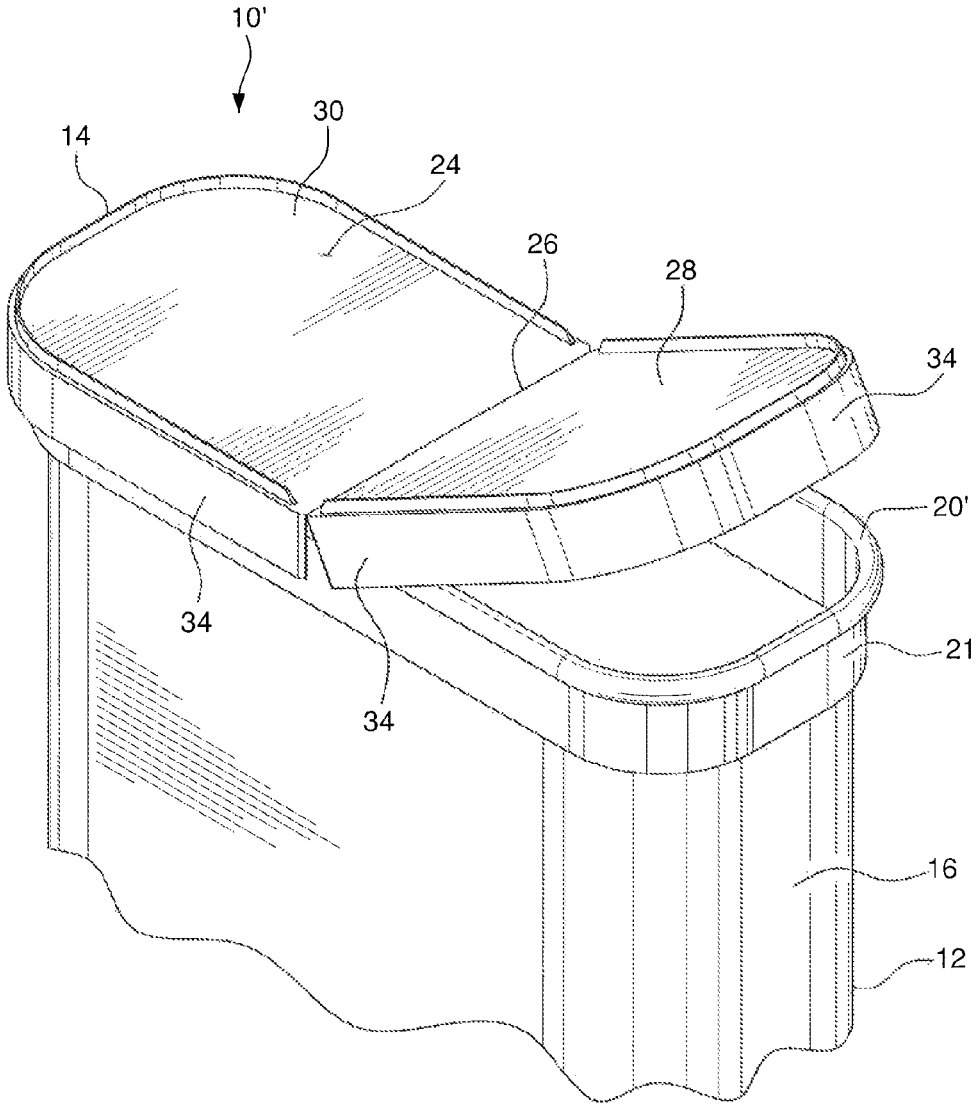
FIG. 6 shows a partial isometric view of the container and overcap with an alternate upper rim design.

In FIG. 6, there is shown an alternate form of the container 10'. In this embodiment, the container body 12 includes an attached rim structure 21 at the upper end of the side wall 16. The rim structure 21 includes a flange that is attached to the side wall 16 and that includes a formed rim 20'. As illustrated, the rim structure 21 is affixed to the outer surface of the container body 12. However the depending flange may also be affixed to the inside surface of the sidewall 16, with the upper edge captured under the rim portion 20'. Affixing the rim structure 21 as shown can be accomplished by an adhesive or any alternate mechanical structure. The rim structure and container may also be integrally formed.

Figure 7:
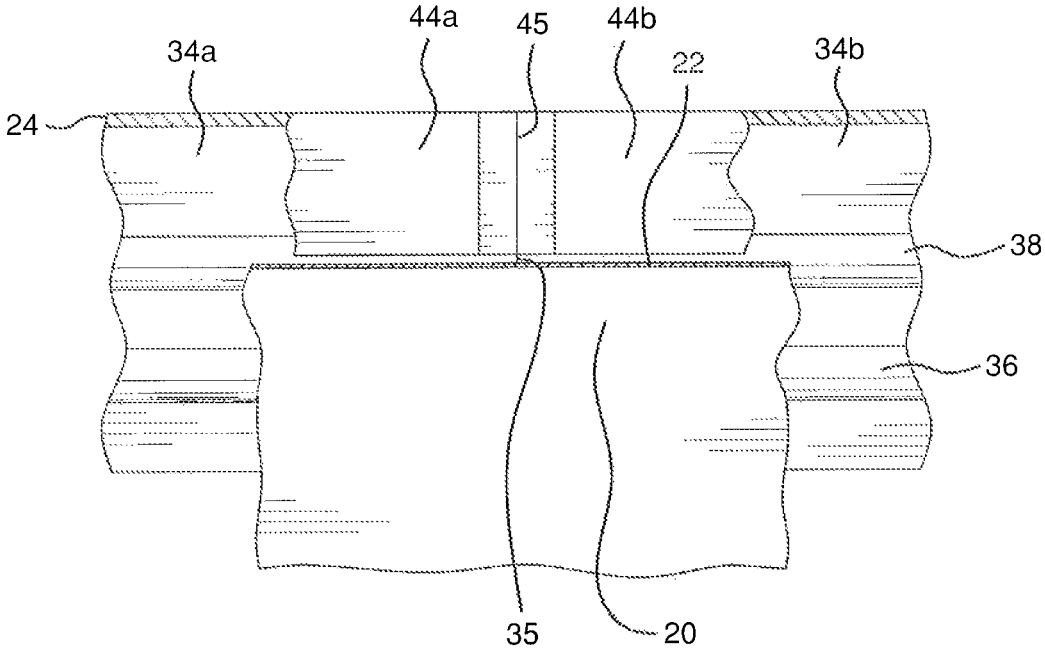
FIG. 7 shows a partial cross-section of the container and overcap combination, with the cap in the first position, as taken along line 7-7 in FIG. 1.
Figure 8:
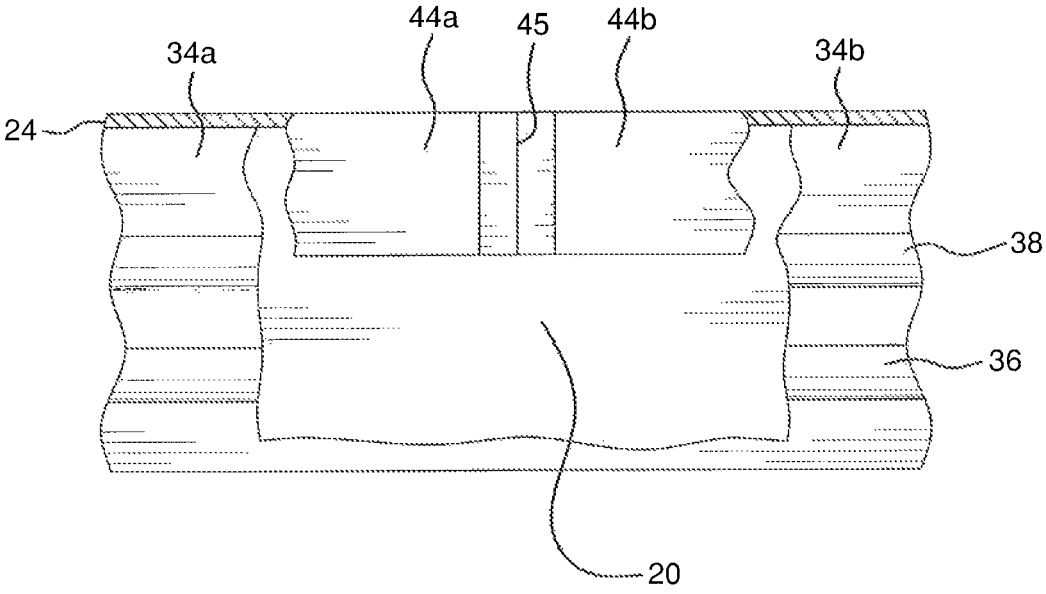
FIG. 8 shows a partial cross-section of the container and overcap combination similar to FIG. 7, with the cap in the second position.

FIGS. 7 and 8 illustrate the relative position of the two portions 34*a*, 34*b* of the outer skirt 34 and the two portions 44*a*, 44*b* of the inner skirt with respect to the rim 20 of the container body 12. In FIG. 7, the overcap 14 is in the first or upper position, with the membrane 22 sealed to the upper surface of the rim 20. The two portions 44*a*, 44*b* of the inner skirt 44 abut one another at seem 45. Directly behind the inner skirt 44 is the break line 35 of the outer skirt 34, which separates the two portions 34*a*, 34*b* of the outer skirt 34. In FIG. 8, the membrane has been removed and the overcap 14 moved to the second position, with the rim 20 positioned within the second or upper groove 42, above the second rib 38. Preferably, the two portions 44*a*, 44*b* of the inner skirt 44 abut or overlap one another at the seam 45. This configuration serves to form at least a partial seal along the inside of the sidewall of the container body, adjacent the rim 20. Thus, when the overcap 14 is closed, the contents of the container 10 are more readily preserved.

The above features of the storage container and overcap combination can be made of any suitable material including but not limited to paper, plastic, metal or wood. Further, other variations and modifications of the structure as illustrated and discussed herein will be apparent to those skilled in the art upon reading the present description. The invention may be embodied in other specific forms without departing from the spirit or essential attributes thereof. Thus, the scope of the impending claims should not be limited by the description of the preferred versions contained herein.

What is claimed is:

1. A storage apparatus comprising:

a container defined by a sidewall having an upper rim, the upper rim defining an open mouth for the container and having an inside rim surface;

a membrane removably affixed to the upper rim and, prior to removal, sealing the open mouth; and an overcap formed to be secured on the upper rim and to cover the membrane and the mouth of the container, the overcap comprising a top panel;

a hinge formed across the top panel, the hinge dividing the top panel into a first moveable portion and a second moveable portion, the first and second moveable portions having a top, a bottom and an outer edge;

a first skirt extending downward from the outer edge of both the first and second moveable portions of the top panel, the first skirt having separate first and second skirt portions, the separate skirt portions combining to surround the upper rim and having opposing ends overlapping one another adjacent the hinge, each skirt portion comprising an upper rib and a lower rib formed on an inside surface of the first skirt and spaced from the bottom of the respective movable portion, the upper and lower ribs creating a lower groove there between, the upper rib and the bottom of the respective movable portion of the top panel creating an upper groove there between, the lower groove sized to engage the upper rim of the container in a first position and the upper groove sized to engage the upper rim of the container in a second position; and a second skirt extending downwardly from the bottom of at least the second movable portion, the second skirt spaced inward from the outer edge of the second moveable portion and from the first skirt, the second skirt spaced from the upper rim in the first position and the second skirt engaging the inside rim surface of the container when the overcap is in the second position where the membrane is removed prior to moving the overcap to the second position.

2. The storage apparatus of claim 1, wherein the second skirt also extends downwardly from the bottom of the first moveable portion.

3. The storage apparatus of claim 1, wherein the second moveable portion is moveable about the hinge.

4. The storage apparatus of claim 1, further comprising a top rib extending upward from the top of the first and second moveable portions of the top panel and located substantially on the outer edge of the first and second moveable portions.

5. The overcap of claim 1, wherein the storage apparatus is polygonal.

6. The storage apparatus of claim 5, wherein the first and second moveable portions further comprise a top rib extending upward from the top of the first and second moveable portions of the top panel and located adjacent the outer edge of the first and second moveable portions.

7. A storage apparatus comprising:

a container, the container comprising a hollow body, a generally rectangular open-mouth, an upper rim, and a removable membrane, the upper rim located along a perimeter of the open mouth, the upper rim defining an inside surface within the open-mouth of the container, the removable membrane affixed to the upper rim and, prior to removal, covering the open-mouth and the inside surface; and an overcap, the overcap comprising a panel dimensioned for covering the open mouth of the container, the panel comprising a hinge, the hinge formed transversely across the panel and dividing the panel into a first moveable flap portion and a second moveable flap portion, the first and second moveable flap portions comprising a top, a bottom, and an outer side;

a first skirt extending downward from the outer side of the first and second moveable flap portions and dimensioned to surround the upper rim of the container, the first skirt comprising a lower rib and an upper rib formed on the inside of the first skirt creating a lower groove between the lower rib and the upper rib and an upper groove between the upper rib and the bottom of the first and second moveable flap portions, the lower groove sized to engage the upper rim of the container in a first position and the upper groove sized to engage the upper rim of the container in a second position; and a second skirt extending downward from the bottom of both the first and second moveable flap portions to a position substantially equal to the bottom of the upper groove, the second skirt located radially inward from the first skirt and spaced such that the second skirt and the upper groove is spaced from the upper rim and the inside surface of the open mount of the container with the overcap in the first position, and wherein the second skirt engages the upper rim and inside surface of the container in the second position with the removable membrane removed.

8. The storage apparatus of claim 7, wherein the first skirt comprises a first portion and a second portion respectively formed on the first and second moveable flap portions and wherein end portions of the first and second portions define a separation break during hinged movement of one of the movable flap portions relative to the other movable flap portion.

9. The storage apparatus of claim 8, wherein the separation break is defined between overlapping surfaces formed on the end portions of the first and second portions of the first skirt.

10. The storage apparatus of claim 1, wherein the vertical dimension of the lower groove formed on the inside of the first skirt is relatively smaller than the vertical dimension of the upper groove.

11. The storage apparatus of claim 1, wherein the second skirt comprises two separate portions, one portion formed on the first moveable flap portion of the top panel and one formed on the second moveable flap portion of the top panel, and wherein end portions of the two separate portions are positioned in an abutting relationship with one another when the first and second moveable flap portions of the top panel are in an un-pivoted position about the hinge.

12. A storage apparatus comprising:

a container having an interior volume defined by a sidewall, the sidewall having an opening therein that is defined by an upper rim having outwardly projected bead formed on the periphery of the upper rim, a removable membrane, the removable membrane sealed to the upper rim and, prior to removal, forming a planar surface extending inwardly from the upper rim and covering the opening; and an overcap removably positioned on the upper rim, the overcap having a top panel having a top surface, a bottom surface and an outer peripheral edge;

a hinge formed across the panel, the hinge dividing the top panel into a first flap portion and a second flap portion, the first flap portion being pivotable about the hinge relative to the second flap portion;

a first skirt extending downward from the outer edge of the top panel, the first skirt forming a continuous surface around the peripheral edge of the top panel, the first skirt having first and second skirt segments corresponding to the first flap portion and the second flap portion, the first and second skirt segments separated from one another at the hinge, each skirt segment having an upper rib and a lower rib formed on an inside surface of each of the first skirt segment and the second skirt segment and spaced from the bottom surface of the top panel, the upper and lower ribs creating a lower groove extending there between, the upper rib and the bottom surface of the top panel defining an upper groove there between, the lower groove formed to retain the outwardly projected bead of the upper rim of the container in a first position wherein the bottom surface of the top panel is spaced from the upper rim of the container, and the upper groove formed to engage the outwardly projected bead of the upper rim of the container in a second position wherein the bottom surface of the top panel is positioned adjacent the upper rim of the container; and a second skirt extending downwardly from the bottom surface of both the first and second moveable portions of the top panel, the second skirt spaced inwardly from the first skirt and defining a gap there between for receiving the upper rim of the container, wherein end portions of the second skirt movable portions define a separation break directly aligned with the separation break between with the first and second skirt segments and the separation breaks are positioned along the line of the hinge, wherein the second skirt is positioned above the planer surface of the removable membrane when the overcap is in the first position on the upper rim of the container, and wherein the gap is formed for receipt of the container rim between the first and second skirt when the overcap is in the second position, the first and second skirt segments and the upper rib combining for engagement of the respective first or second moveable portions with the outwardly projected bead of the upper rim of a container, the upper rim positioned within the gap and the second skirt positioned within the container opening.

13. The storage apparatus of claim 12, wherein the separation break between with the first and second skirt segments of the first skirt is defined between overlapping surfaces formed on the end portions of the first and second segments of the first skirt.

14. The storage apparatus of claim 12, wherein the vertical dimension of the lower groove formed on the inside of the first skirt is relatively smaller than the vertical dimension of the upper groove.

15. The storage apparatus of claim 12, wherein end portions of the two separate portions of the second skirt are positioned in an abutting relationship with one another when the first and second flap portions of the top panel are in an un-pivoted position about the hinge.

* * * * *